United States Patent [19]

Killian

[11] Patent Number: 4,700,915

[45] Date of Patent: Oct. 20, 1987

[54] TABLE LEG ASSEMBLY AND METHOD OF ASSEMBLING SAME

[75] Inventor: Edmund Killian, Merrick, N.Y.

[73] Assignee: Finkel Outdoor Products, Inc., New York, N.Y.

[21] Appl. No.: 928,792

[22] Filed: Nov. 10, 1986

[51] Int. Cl.[4] ..... F16M 11/20

[52] U.S. Cl. ..... 248/188.1; D6/495; 108/150; 248/163.1; 248/432; 403/391

[58] Field of Search ..... 248/188.1, 188, 172, 248/440, 151, 163.1, 432; 108/150, 161; 403/391, 177, 217; D6/495, 498

[56] References Cited

U.S. PATENT DOCUMENTS

| | | | |
|---|---|---|---|
| D. 147,902 | 11/1947 | Gray | D6/498 |
| 3,312,438 | 4/1967 | Goetz et al. | 248/188.1 X |
| 3,588,015 | 6/1971 | Bereday | 248/188.1 |
| 3,863,875 | 2/1975 | Olson | 248/188.1 |

FOREIGN PATENT DOCUMENTS

| | | | |
|---|---|---|---|
| 2225048 | 10/1974 | France | 403/391 |

*Primary Examiner*—Ramon O. Ramirez

*Attorney, Agent, or Firm*—McAulay, Fields, Fisher, Goldstein & Nissen

[57] ABSTRACT

A table leg assembly and method of assembling table legs comprises two pairs of leg members, each pair having linear intermediate portions fixedly connected by a connecting member in one of two pair of diametrically opposed axial indentations in the connecting member. The two pair of leg members are connected by disposing one connecting member over the other connecting member with the intermediate portions of the one pair of leg members sliding through the unused pair of indentations in the other connecting member and the intermediate portions of the other pair of leg members sliding through the unused pair of indentations in the one connecting member until the one connecting member contacts the other connecting member.

12 Claims, 6 Drawing Figures

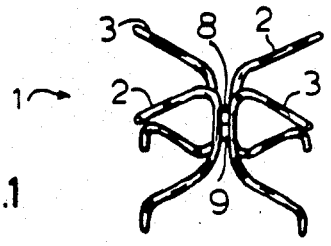
FIG.1
FIG.2
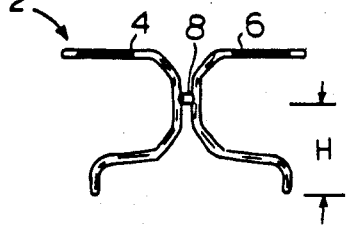
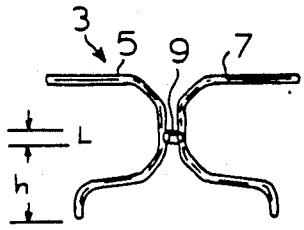
FIG.3
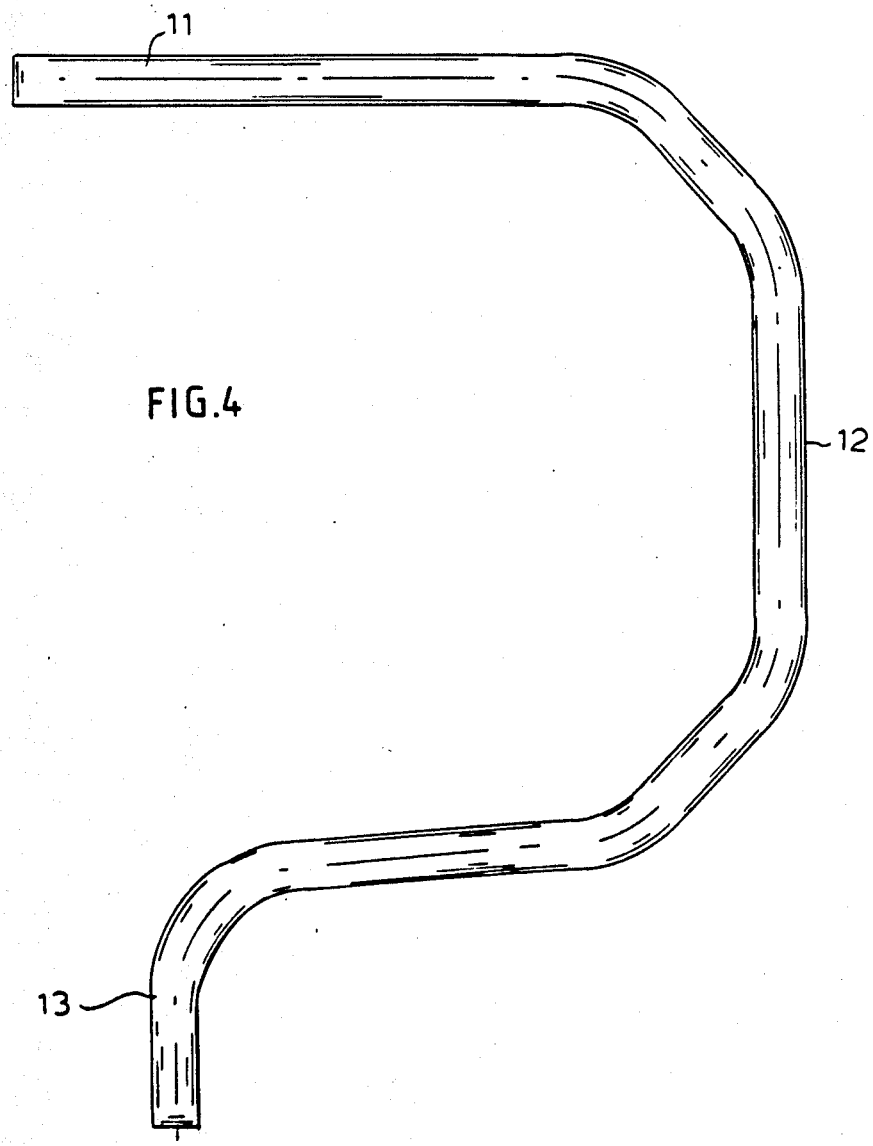
FIG.4

TABLE LEG ASSEMBLY AND METHOD OF ASSEMBLING SAME

BACKGROUND OF THE INVENTION

The present invention relates to a table leg construction and the method of assembling same, and more particularly to a construction and a method of assembly for outdoor furniture having tubular metal legs and which is capable of being assembled and disassembled when required.

Outdoor furniture, specifically outdoor tables, have leg assemblies which are either welded together and therefore cannot be disassembled without being rendered unusable, or are connected together with fastening means including screws and the like which require special tools or a great deal of time and skill to assemble and disassemble.

SUMMARY OF THE INVENTION

The main object of the present invention is to provide a table leg construction and a method of assembling same which requires no special tools and which can be assembled and disassembled easily by the user while providing a sturdy support for a table top and the like.

These and other objects and advantages of the present invention will be achieved in accordance with the present invention by a method of assembling table legs comprising the steps of providing two pairs of leg members, each pair having linear intermediate portions fixedly connected by a connecting member in one of two pair of diametrically opposed axial indentations in the connecting member and connecting the two pairs of leg members by disposing one connecting member over the connecting member with the intermediate portions of one pair of leg members sliding through the unused pair of indentations in the other connecting member, and the intermediate portions of the other pair of leg members sliding through the unused pair of indentations in the one connecting member until the one connecting member contacts the other connecting member.

The present invention also includes a table leg construction which comprises two pairs of leg members, each leg member having one end portion for resting on the floor, another end portion for supporting a table top, and a linear intermediate portion disposed vertically when the one end portion is resting on the floor.

Leg connecting means comprises two connecting members each having a given length and two pair of diametrically opposed axially extending indentations, each configured to slidably receive the intermediate portion of each leg member.

One pair of leg members has the intermediate portions thereof fixedly connected in one pair of diametrically opposed indentations of one connecting member and the other pair of leg members has the intermediate portions thereof fixedly connected in one pair of diametrically opposed indentations of the other connecting member.

The one connecting member is disposed a first distance from the floor when the one end portions of the one pair of leg members are resting on the floor and the other connecting member is disposed a first distance plus the given length from the floor when the one end portions of the other pair of leg members are resting on the floor.

As a result, leg members are assembled by disposing the other connecting member over the one connecting member with the intermediate portions of the one pair of leg members sliding through the unused pair of indentations in the other connecting member and the intermediate portions of the other pair of leg members sliding through the unused pair of indentations in the one connecting member until the other connecting member contacts the one connecting member.

In accordance with the features of the present invention, each connecting member preferably comprises a tubular member having a circular cross section and partial cylindrical indentations therein. The connecting members are preferably identical. The intermediate portions of the leg members and, preferably the entire leg members are tubular with circular or rectangular cross sections.

Each leg member is configured to dispose the intermediate portion as the radially innermost portion of the leg member when assembled.

These and other features and advantages of the present invention will be seen from the following detailed description taken with the attached drawings, wherein:

BRIEF DESCRIPTION OF THE DRAWINGS

FIG. 1 is a side view of the table leg assembly or construction according to the present invention;

FIG. 2 is a front view of one pair of connected leg members forming part of the structure shown in FIG. 1;

FIG. 3 is a front view of another pair of connected leg members forming part of the structure shown in FIG. 1;

FIG. 4 is a side view of a leg member according to the present invention;

DETAILED DESCRIPTION OF THE INVENTION

Figure 6:
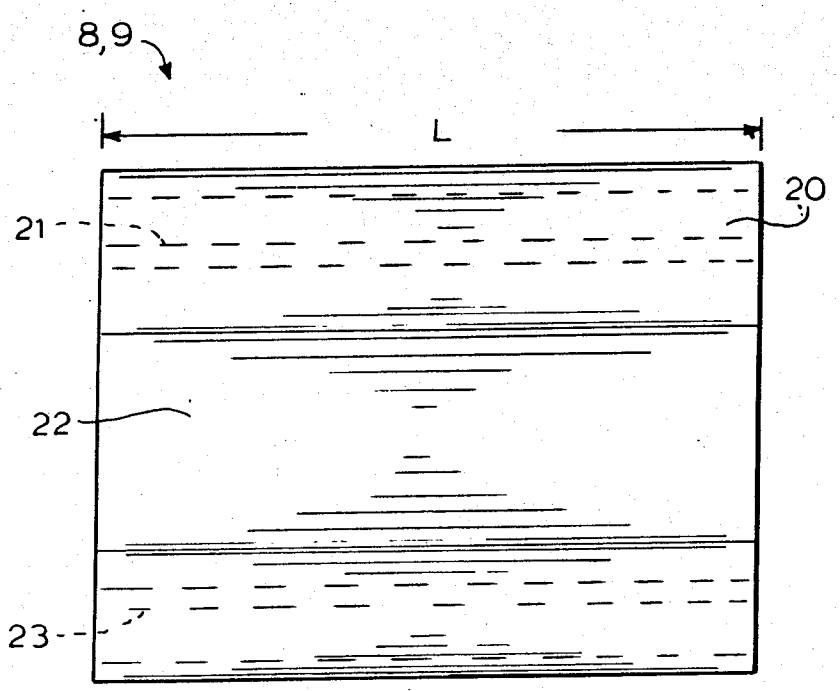
FIG. 6 is a side view of the connecting member shown in FIG. 5.

Referring now to FIGS. 1–3, the table leg construction or assembly 1 according to the present invention includes two pairs of leg members 2, 3 with pair 2 comprising leg members 4 and 6 interconnected by a connecting member 8 and pair 3 comprising leg members 5 and 7 interconnected by connecting member 9.

A single one of the leg members 4–7 is shown in more detail in FIG. 4 and comprises a one piece tubular aluminum leg with a circular cross section having an outside diameter of approximately 1.25", although it can also have a rectangular cross section.

Each leg member has one end portion 11 on which a table top can be supported, another end portion 13 which is configured to rest on the floor during use, and an intermediate portion 12 which is linear and is disposed vertically when end portion 13 is disposed on the floor during use. Intermediate portion 12 is configured to be disposed at the radially innermost portion of the leg member when the leg members are assembled. End portion 13 is approximately 4" long, end portion 11 is approximately 12" long and the intermediate portion 12 is approximately 8" in length and are interconnected by curved end portions of the leg member to form a unitary structure as shown.

Figure 5:
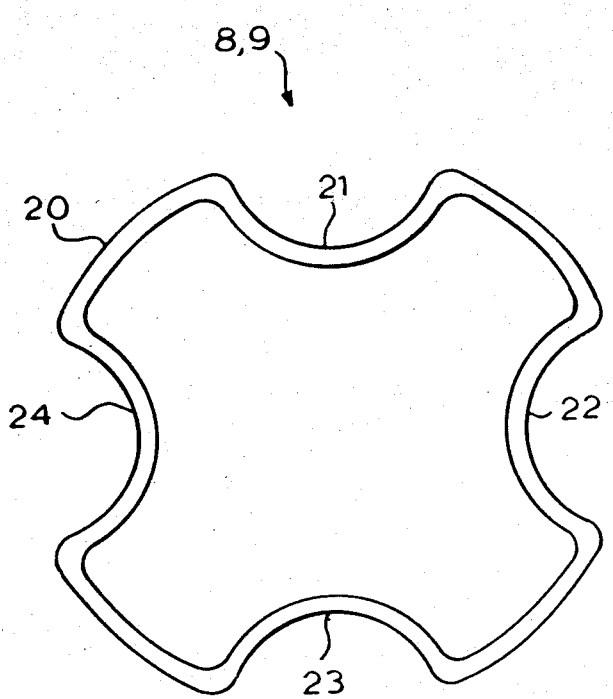
FIG. 5 is a cross-sectional view of the connecting member according to the present invention.

The connecting members 8, 9 are preferably identical and are shown in more detail in FIGS. 5 and 6.

Each member 8, 9 is preferably formed from extruded aluminum with a wall thickness of approximately 0.100"

and a length L of approximately 2". The outer diameter of the connecting member is 3.5" and it includes two pairs of diametrically opposed axial indentations 21–24 each having a radius of 0.64" and cylindrical in shape. The shape of the indentations can of course be varied for leg members having different configurations.

Referring again to FIGS. 1–3, connecting member 9 is fixedly connected to the intermediate portions 12 of leg members 5 and 7 by welding or some other metal fastening process to dispose connecting member 9 at a height h from the end of end portion 13 or from the floor when the pair 3 of leg members is disposed in the position shown in FIG. 3.

Connecting member 8 is also fixedly connected in the same manner as connecting member 9 to intermediate portions 12 of leg members 4 and 6 but at a height H which is equal to the height h plus the length L of connecting member 9. In this manner, the pair 2 of leg members with connecting member 8 is disposed above pair 3 and 180° out of phase with leg members 5 and 7 so that the intermediate portions 12 of leg members 4 and 6 are slidably received in the unused pair of indentations in connecting member 9 and the intermediate portions 12 of leg members 5 and 7 are disposed in the unused pair of indentations in connecting member 8.

During assembly, the legs 5 and 7 can be spread apart as needed so that the leg members 4 and 6 can slip down more easily and the downward movement of leg members 4 and 6 is carried out until connecting member 8 contacts connecting member 9. At this point, the bottom portions 13 of all four legs will be in the same plane and thus resting on the floor. The inherant flexibility of the tubular aluminum legs permits them to be spread during connection whereas the resiliency of the legs causes them to spring back against the connecting members to firmly grip the same.

It will be appreciated that the instant specification and claims are set forth by way of illustration and not limitation, and that various modifications and changes may be made without departing from the spirit and scope of the present invention.

What is claimed is:

1. A table leg assembly comprising:

two pairs of leg members, each leg member having one end portion for resting on the floor, another end portion for supporting a table top and an intermediate portion;

leg connecting means comprising two connecting members each having a given length and at least a pair of diametrically opposed indentations each configured to slidably receive the intermediate portion of each leg member;

wherein one pair of leg members has the intermediate portions thereof fixedly connected to one of the connecting members and the other pair of leg members has the intermediate portions thereof fixedly connected to the other connecting member; and wherein the one connecting member is disposed a first distance from the floor when the one end portions of the one pair of leg members are resting on the floor and the other connecting member is disposed the first distance plus at least the given length from the floor when the one end portions of the other pair of leg members are resting on the floor;

whereby the leg members are assembled by disposing the other connecting members over the one connecting member with the intermediate portions of the one pair of leg members sliding through the pair of indentations in the other connecting member and the intermediate portions of the other pair of leg members sliding through the pair of indentations in the one connecting member until the other connecting member contacts the one connecting member.

2. The table assembly according to claim 1, in which each of said connecting members has a second pair of diametrically opposed indentations, said one pair of leg members having the respective intermediate portions thereof fixedly connected in said second pair of indentations of said one connecting member, and the intermediate portions of said other pair of leg members are respectively connected in the second pair of indentations of said other connecting member.

3. The table assembly according to claim 1, in which said indentations extend axially.

4. The table leg assembly according to claim 1, wherein each connecting member comprises a tube having a circular cross section and partial cylindrical indentations.

5. The table leg assembly according to claim 1, wherein the connecting members are identical.

6. The table leg assembly according to claim 2, wherein the intermediate portion leg members are tubular with a circular cross-section.

7. The table leg assembly according to claim 1, wherein each leg member is configured to dispose the intermediate portion as the radially innermost portion of the leg member when assembled.

8. The table leg assembly according to claim 1, in which said intermediate portion is a linear portion adapted to be disposed vertically when the associated one end portion is resting on the floor.

9. The table leg assembly according to claim 1, in which said leg members are flexible and resilient.

10. The table leg assembly according to claim 1, wherein each leg member comprises a tubular hollow member.

11. A method of assembling table legs comprising the steps of:

providing two pairs of leg members, each pair having intermediate portions fixedly connected by a connecting member having at least a pair of indentations;

connecting the two pairs of leg members by disposing one connecting member over the other connecting member with the intermediate portions of the one pair of leg members sliding through the pair of indentations in the other connecting member in the vertical direction and the intermediate portions of the other pair of leg members sliding through the pair of indentations in the one connecting member in the vertical direction.

12. A method of assembling table legs comprising the steps of:

providing two pairs of leg members, each leg member having one end portion for resting on the floor, another end portion for supporting a table top, and a linear intermediate portion disposed vertically when the one end portion is resting on the floor, with each pair of leg members connected by a connecting member having a given length and two pair of diametrically opposed axial indentations each configured to slidably receive the intermediate portion of each leg member by fixedly connecting the intermediate portions of one pair of leg members in one pair of diametrically opposed indentations of one connecting member and fixedly connecting the intermediate portions of the other pair of leg members in one pair of diametrically opposed indentations of the other connecting member; wherein the one connecting member is disposed a first distance from the floor when the one end portion of the one pair of leg members are resting on the floor and the other connecting member is disposed the first distance plus at least the given length from the floor when the one end portions of the other pair of leg members are resting on the floor; and connecting the two pairs of leg members by disposing the other connecting members over the one connecting member, sliding the intermediate portions of the one pair of leg members through the unused pair of indentations in the other connecting member and sliding the intermediate portions of the other pair of leg members through the unused pair of indentations in the one connecting member until the other connecting member contacts the one connecting member.

* * * * *